US009272825B2

(12) United States Patent
De Rosa

(10) Patent No.: US 9,272,825 B2
(45) Date of Patent: Mar. 1, 2016

(54) ANTI-DRIP CAP WITH AN ELASTICALLY RETURNED MOBILE DISPENSER COVER AND TWO ANGULAR POSITIONS

(71) Applicant: MAITRISE & INNOVATION, Val De Reuil (FR)

(72) Inventor: Daniel De Rosa, Louviers (FR)

(73) Assignee: MAITRISE & INNOVATION, Val de Reuil (FR)

( * ) Notice: Subject to any disclaimer, the term of this patent is extended or adjusted under 35 U.S.C. 154(b) by 11 days.

(21) Appl. No.: 14/346,821

(22) PCT Filed: Sep. 24, 2012

(86) PCT No.: PCT/EP2012/068738

§ 371 (c)(1),
(2) Date: Mar. 24, 2014

(87) PCT Pub. No.: WO2013/041716

PCT Pub. Date: Mar. 28, 2013

(65) Prior Publication Data

US 2014/0252038 A1 Sep. 11, 2014

(30) Foreign Application Priority Data

Sep. 22, 2011 (FR) ..... 11 58443

(51) Int. Cl.
*B67D 1/00* (2006.01)
*B65D 50/00* (2006.01)
(Continued)

(52) U.S. Cl.
CPC ..... *B65D 50/00* (2013.01); *B65D 47/2087* (2013.01); *B65D 47/32* (2013.01)

(58) Field of Classification Search
CPC .... B65D 47/32; B65D 50/00; B65D 47/2087; B65D 41/0471; B65D 47/242
USPC ..... 222/153.14
See application file for complete search history.

(56) References Cited

U.S. PATENT DOCUMENTS 4,823,994 A * 4/1989 Laauwe ..... 222/521
5,038,967 A * 8/1991 Braun ..... 222/519
(Continued)

FOREIGN PATENT DOCUMENTS

DE 8715396 U1 3/1988
DE 4328582 A1 3/1995
(Continued)

OTHER PUBLICATIONS

International Search Report, dated Jan. 30, 2013, from corresponding PCT application.

*Primary Examiner* — Patrick M Buechner
*Assistant Examiner* — Jeremy W Carroll
(74) *Attorney, Agent, or Firm* — Young & Thompson

(57) ABSTRACT

An "anti-drip" cap for a deformable bottle including a base, connecting with the bottle, covered by a cover, including an outlet opening, the cap being movable between a sealing and locking configuration corresponding to a first angular position and a low vertical position of the cover, an intermediate configuration for venting the cap by an escape element corresponding to a second angular position and the low vertical position of the cover, and a dispensing configuration of the cap corresponding to the second angular position and a high vertical position of the cover in which the outlet opening is released, the cap passing from the intermediate configuration to the dispensing configuration once the cover is moved by the pressure of a product supplying the base, and returning to the intermediate configuration when the cover is returned under the effect of an elastic return element interposed between the cover and the base.

11 Claims, 4 Drawing Sheets

(51) Int. Cl.
*B65D 47/20* (2006.01)
*B65D 47/32* (2006.01)

(56) References Cited

U.S. PATENT DOCUMENTS 5,715,977 A * 2/1998 Goncalves ..... 222/521
6,065,648 A * 5/2000 Tauber ..... 222/153.14
6,135,329 A * 10/2000 Stoneberg et al. ..... 222/521
6,543,650 B1 * 4/2003 Sprick et al. ..... 222/153.14
8,464,916 B2 6/2013 De Rosa
2010/0230376 A1 * 9/2010 De Rosa et al. ..... 215/228
2014/0202981 A1 * 7/2014 De Rosa ..... 215/329

FOREIGN PATENT DOCUMENTS

FR 2922527 A1 4/2009
WO 9621601 A1 7/1996
WO 2010133467 A1 11/2010

* cited by examiner

ANTI-DRIP CAP WITH AN ELASTICALLY RETURNED MOBILE DISPENSER COVER AND TWO ANGULAR POSITIONS

The invention relates to a so-called "anti-drip" cap for a deformable bottle.

The invention relates, more particularly, to a so-called "anti-drip" cap for a deformable bottle, particularly a squeeze bottle containing a cosmetic, pharmaceutical, industrial or food product in liquid or cream form, including:

- a substantially tubular base, which is intended to be fixed in an impermeable manner on a complementary tubular neck of the bottle, and a so-called inlet transverse wall of which that seals the neck of the bottle includes at least one inlet opening connecting with the inside of the bottle,
- a substantially tubular cover, which covers the base in an impermeable manner, and a so-called "upper" transverse wall of which includes at least one product outlet opening, the cover and the base defining, in an impermeable manner, a chamber for passage of the product, interposed between the inlet opening of the base and the outlet opening for the product, said cap being likely to occupy at least:

- a so-called sealing and locking, first configuration, associated with a first angular end position of the cover and with a first low axial position of said cover with respect to base, in which the cover is immobilized on the base and in which the product outlet opening is lowered onto a sealing element which projects coaxially with the base from its inlet transverse wall, an end bearing area of the sealing element sealing in an impermeable manner the product outlet opening,
- a so-called dispensing, second configuration, associated with a second angular end position of the cover and with a second high axial position of said cover with respect to the base in which the outlet opening is placed with a defined high clearance above the sealing element in order to allow the product to pass through the inlet and outlet openings and the passage chamber, once the squeeze bottle is pressed, passing through a so-called venting, third intermediate configuration in which the relative positions of the cover and of the base define an escape path with small dimensions connecting the passage chamber with the outside in order to ventilate the deformable bottle, allowing, in particular, the bottle to regain its shape after having been urged.

Numerous examples of caps of this type are known.

Such a cap is commonly used in the cosmetic or food industry to dispense a creamy product.

Such a cap, however, has the disadvantage of only including one sealing low position or one dispensing high position.

Therefore, such a cap needs to be handled each time that it must be used in order to open it, at the risk of the product contained therein drying and closing the product outlet opening.

Moreover, such a cap cannot remain in the dispensing high position without the risk of it being knocked over and, therefore, the product contained therein escape therefrom.

In WO-A1-2010/133467 was proposed an anti-drip cap, the product outlet opening of which only opens when the cap is supplied with product, for example when pressure is exerted on a squeeze bottle on which the cap is screwed.

In this device, the cap is movable between a position locked on the base and an unlocked position allowing venting of the deformable bottle thanks to a reduced clearance between cap and base, and ejecting the product once an injection of product coming from the bottle exerts on the cap a pressure that is sufficient for lifting it.

This design has the risk of a small product leak in the unlocked position, the bottle ventilation taking place by a high size opening.

The invention remedies this disadvantage by providing a cap of the preceding type including a venting means, preventing any risks of leaks.

For this purpose, the invention proposes a cap of the previously described type, characterized in that the so-called venting, third intermediate configuration is associated with the second angular end position of the cover and with the first low axial position of said cover with respect to the base, and in that, in the second angular position of the cover, a defined-stiffness elastic return means is interposed between the cover and the base, in order to allow the cap to pass from its third to its second configuration, the cover raising towards its dispensing high position once an injection of product coming from the neck of the bottle exerts on the upper wall of the passage chamber a pressure that is sufficient for the resulting force to exceed the force of said elastic return means, and the automatic return of the cap from its third to its second configuration, the cover being returned towards its low vertical position on the base once the pressure of the product is released.

According to other features of the invention:

- the escape path is constituted by two channels formed in the base and the cover, respectively, which are butt-joined to each other in only the second angular position,
- the channels include:
  - at least one first countersink, which is formed in the periphery of the end bearing area of the sealing element, and which extends at least until the free end of said bearing area in order to connect with the outside of the cap,
  - a second countersink, formed in a lower face of the upper wall of the cover, which connects the periphery of the opening and the passage chamber,
- the bearing area of the sealing element is tapered and the first countersink is oriented along a generatrix of said tapered bearing area,
- the second countersink has a radial orientation,
- an inner tubular bearing area of the cover includes at least a first element and a second element projecting radially towards the inside of the cover which are intended to simultaneously engage at least a first angular stop and at least a first upper axial stop, secured to the base, respectively, in order to define the first configuration of the cap,
- the cover includes at least a third element projecting radially towards the inside of the cover from its inner bearing area, and a fourth element inside the cover which are intended to simultaneously engage at least a second angular stop and the elastic return means, secured to the base, respectively, to define the second and third configurations of the cap,
- the inner tubular bearing area of the cover includes at least one pin, forming the first to fourth elements, which projects radially towards the inside of the cover, and which is intended to engage at least one oblong track which extends in the periphery of a lower end of the base along an angular sector corresponding to the angle formed between the first and second angular positions, said track including the first angular stop, first upper axial stop, second angular stop and elastic return means, and defining the first to third configurations of the cap,
- the track includes:

a first section, with a width corresponding to the height of the pin, which includes a first end of the track forming the first angular stop of the pin, an upper edge of which defines the first upper axial stop of the pin, to define the first configuration of the cap, a second section, with a width corresponding to the height of the pin, including a first boss, borne in particular by a lower edge of the track, which is placed at a distance from the first end of the track substantially corresponding to the width of the pin, allowing the pin to be locked in the first section, and which the pin can cross over when the cover is rotated, a third section, a fourth section, with a width corresponding to the height of the pin, including a second boss, borne in particular by a lower edge of the track, which is placed at a distance from a second track end substantially corresponding to the width of the pin, allowing the pin to be locked in a fifth section, and which the pin can cross over when the cover is rotated, the fifth section, which extends between the second boss and the second end of the track, which includes a second end of the track forming the second angular stop of the pin, and an elastically returned upper edge of which forms the elastic return means, in order to define the second and third configurations of the cap, the upper edge of the fifth section is borne by an elastic lug, a first end of which consists of a single piece with a first cylindrical part of a body of the base, which extends with a defined clearance about a second cylindrical part of the body of the base, and a second free flexible end of which includes a lower edge constituting the upper edge of the fifth section, the inner tubular bearing area of the cover includes as many pins, angularly spread in a regular manner, as the base includes tracks, elastic lugs and first countersinks, angularly spread in a regular manner, the base includes an upper transverse wall resting in an impermeable manner on the neck of the bottle, from which a tubular well extends in the inside of the neck of the bottle, said well including a lower transverse wall forming the inlet transverse wall including the opening and receiving in a sliding manner a tubular chimney which extends from a transverse wall of the cover, said chimney including at its lower end a tapered impermeability lip, to define the passage chamber in an impermeable manner.

Other features and advantages of the invention will emerge upon reading the following detailed description for the understanding of which will referred to the appended drawings in which.

In the following description, identical reference numbers designate pieces that are identical or have similar functions.

Figure 1:
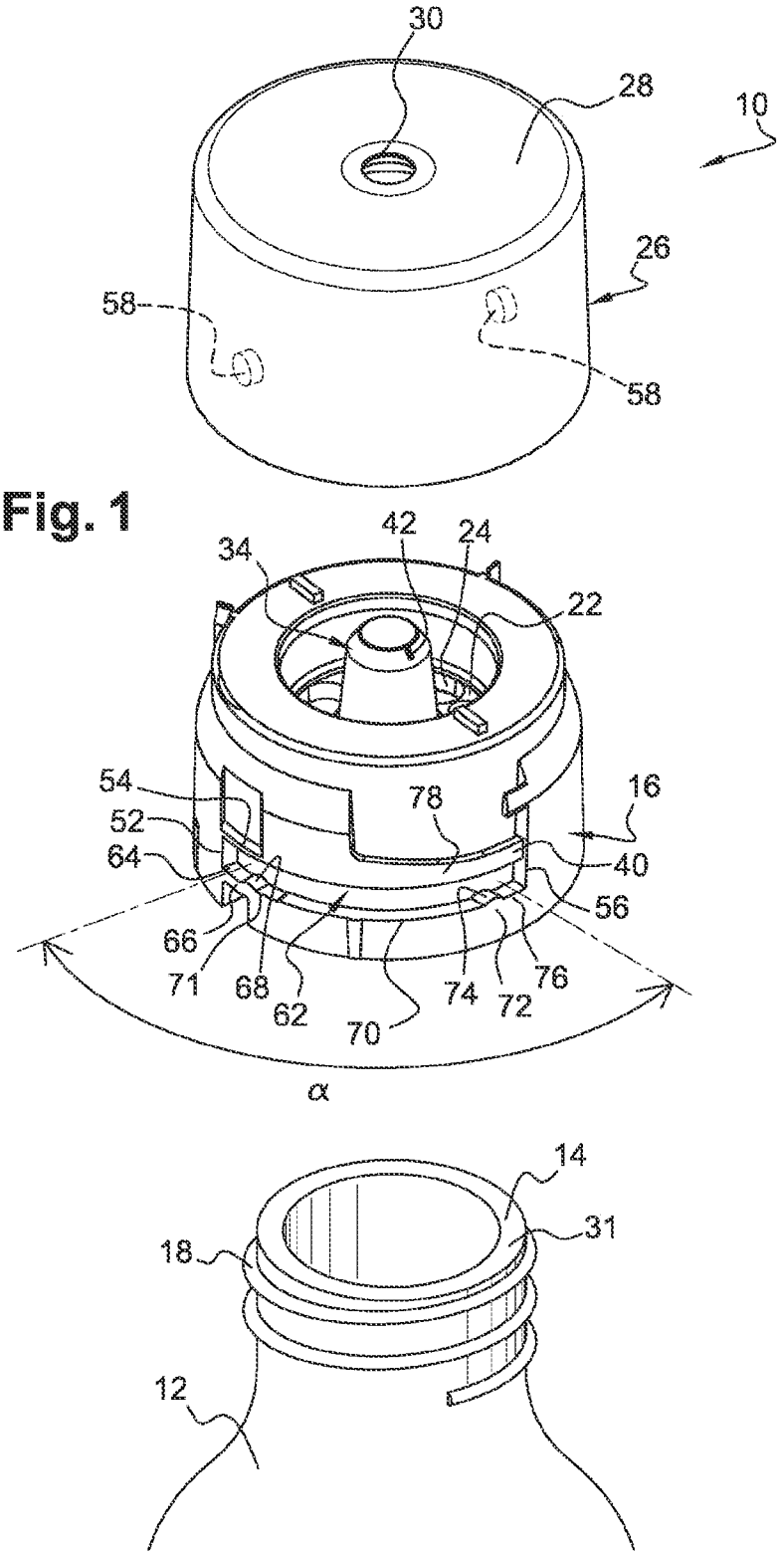
FIG. 1 is an exploded perspective view with extraction of an anti-drip cap according to the invention.
Figure 2:
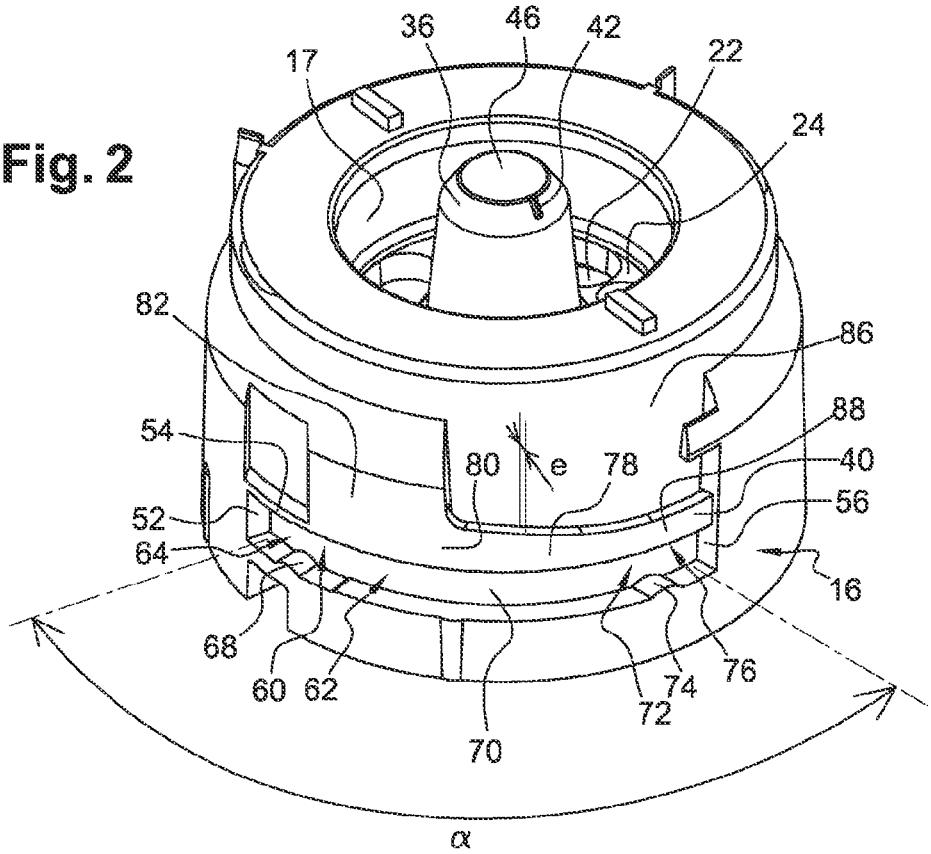
FIG. 2 is a detailed perspective view of the base of the cap.

The figures show a so-called "anti-drip" cap 10 produced in accordance with the invention.

In a known manner, the cap 10 is intended to be provided for a deformable bottle 12 for a cosmetic, pharmaceutical, industrial or food product, in liquid or cream form.

It will, therefore, be understood that the field of use of the cap 10 is extremely varied.

The deformable bottle 12 can, in particular, be a rigid bottle, a wall or piston of which is movable. This type of bottle is widely known from the prior art and is, for example, used to contain toothpastes.

In such a bottle, the volume of the bottle varies with the use thereof, since the movement of the movable wall accompanies the discharge of the product. The volume of the bottle is, in this case, always fully filled with product.

The bottle 12 can also more simply be a squeeze bottle that is intended to be pressed in order to cause the product to be discharged.

In such a bottle, the volume of the bottle does not change on the whole, since the product which is discharged from the bottle has been replaced with air when the pressure exerted on the bottle has been released.

In the remainder of the present description, the invention will be explained with reference to a squeeze bottle 12, but it will be understood that this arrangement cannot limit the invention.

The bottle 12 includes a neck 14. In a known manner, the cap 10 includes a substantially tubular base 16, which is intended to be fixed in an impermeable manner on the complementary tubular neck 14 of the bottle 12.

The base 16 can be fixed on the neck 14 by any means known from the prior art, for example by socketing, bonding, welding or screwing.

Thus, by way of example, and in a manner which does not limit the invention, the neck 14 of the bottle 12 which has been represented herein includes threads 18 which are intended to receive in an impermeable manner a complementary internal thread 20 of the base 16.

Figure 3:
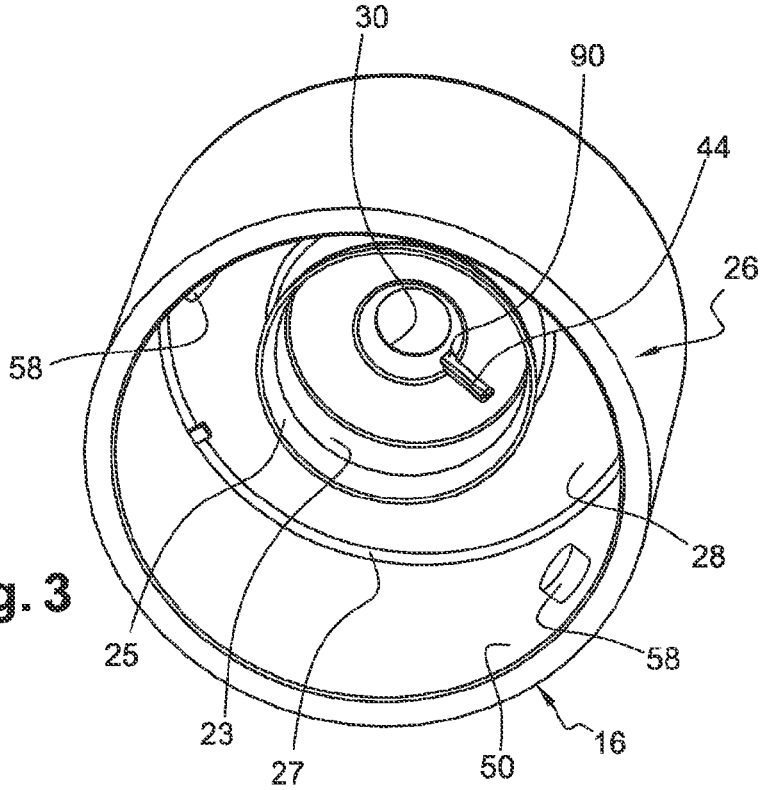
FIG. 3 is a perspective view of the cover.

As illustrated more particularly in FIGS. 1 and 3, a so-called "inlet" transverse wall 22 of the base, which seals the neck 14 of the bottle 12 includes at least one inlet opening 24 which is intended to connect with the inside of the bottle 12.

The base 16 receives a substantially tubular cover 26, which covers, in an impermeable manner, the base 16, and a so-called "upper" transverse wall of which includes at least one product outlet opening 30.

Figure 4:
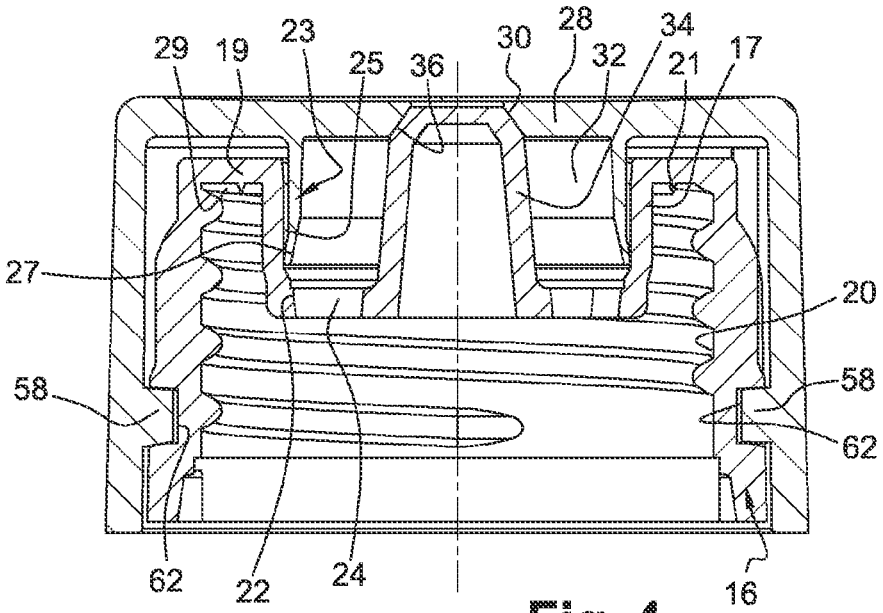
FIG. 4 is a sectional view of the cap in the first configuration of the cap.
Figure 5:
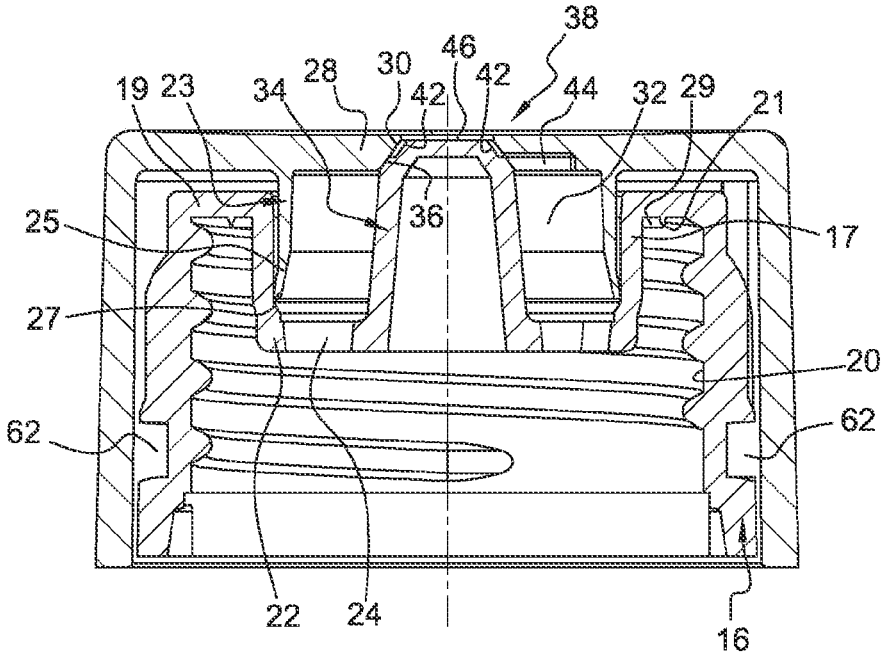
FIG. 5 is a sectional view of the cap in the third configuration.
Figure 6:
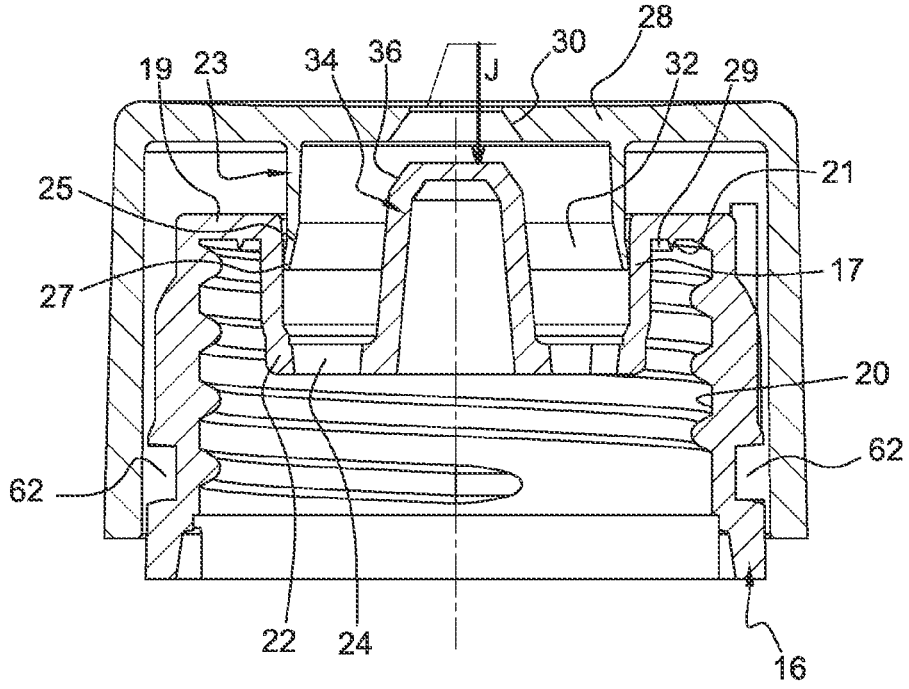
FIG. 6 is a sectional view of the cap in the second configuration of the cap.

Thus, as illustrated in FIGS. 4 to 6, the cover and the base 16, define, in an impermeable manner, a chamber 32 for passage of the product, interposed between the inlet opening 24 of the base 16 and the product outlet opening 30.

In the preferred embodiment of the invention, the inlet wall 22 of the base 16 including the inlet opening 24 is placed at the lower end of a tubular well 17 which extends from an upper transverse wall 19 of the base 16 to the inside of the neck 14 of the bottle 12.

Advantageously, the upper transverse wall 19 resting in an impermeable manner on the neck 14 of the bottle 12. In particular, a circular ring 21, borne by a lower face 29 of the upper transverse wall 19, is intended to be placed in contact with an upper face 31 of the neck of the bottle to insure the impermeability between the bottle 12 and the base 16.

The well 17 receives in a sliding manner a tubular chimney 23 which extends from the upper transverse wall 28 of the cover 26, said chimney including at its upper end the outlet opening 30.

In that way, the tubular well 17 and the tubular chimney define the passage chamber 32 in a perfectly impermeable manner.

In particular, the tubular chimney 23 includes at its lower end 25 a tapered lip 27 ensuring the impermeability with the well 17.

This tapered lip has the advantage, compared with a conventional annular bead, of providing an impermeability all the more increased that the passage chamber 32 is subjected to the pressure of the product that passes through it, the product pressure actually pressing the tapered lip 27 against the wall of the well 17.

It will nevertheless be understood that this arrangement does not limit the invention and that any configuration allowing to define a passage chamber 32 between the base 16 and the cover 26 can be suitable for the correct implementation of the invention.

In a known way, as illustrated in FIG. 4, the cap 10 is likely to occupy a so-called sealing and locking, first configuration, associated with a first angular end position of the cover 26 and with a first low axial position of said cover 26 with respect to the base 16, in which the cover is immobilized on the base and in which the product outlet opening is lowered onto a sealing element 34 which projects coaxially with the base 16 from its inlet transverse wall 22, an end bearing area 36 of the sealing element 34 sealing, in an impermeable manner, the product outlet opening 30 of the cover 26.

As illustrated in FIG. 6, the cap 10 is likely to occupy a so-called dispensing, second end configuration, associated with a second angular end position of the cover 26 and with a second high axial position of said cover 26 with respect to the base 16 in which the outlet opening 30 is placed with a defined high clearance "J" above the sealing element 34 in order to allow the product to pass through the inlet and outlet openings 24 and 30 and the passage chamber 32 when the product to be dispensed is subjected to a pressure, that is especially in the case of a squeeze bottle when it is pressed.

Ultimately, as illustrated in FIG. 5, the cap 10 is likely to pass from the first to the second position, passing through a so-called venting, third intermediate configuration, in which the relative positions of the cover 26 and of the base 16 define an escape path 38 with small dimensions connecting the passage chamber 32 with the outside in order to ventilate the bottle 12, allowing, in particular, the bottle 12, when it is a squeeze bottle 12, to regain its shape once pressed.

Classically, the escape path is produced, in the third angular configuration, by an intermediate axial position of the cover 26, along a reduced, non-zero clearance, allowing to partially open the opening 30.

This solution does not eliminate all risk of escape in case the bottle 12 is knocked over.

For this purpose, the invention proposes an anti-drip cap 10 of the previously described type, characterized in that the so-called venting, third intermediate configuration is associated with the second angular end position of the cover 26 and with the first low axial position of said cover 26 with respect to the base 16, and in that, in the second angular position of the cover, a defined-stiffness elastic return means 40 is interposed between the cover 26 and the base 16, in order to allow the cap 10 to pass from its third to its second configuration, the cover 26 raising towards its dispensing high position once an injection of product coming from the neck 14 of the bottle 12 exerts on the upper wall 28 of the passage chamber 32 a pressure that is sufficient for the resulting force to exceed the force of said elastic return means 40, and the automatic return of the cap from its third to its second configuration, the cover 26 being returned to its low vertical position on the base 16 once the pressure of the product is released.

In this configuration, the cover 26 occupying the same axial position with respect to the base 16 in the second and third positions of the cap 10, the escape path 38 is defined by the angular position of the cover 26.

Thus, in the third position of the cap 10 which has been shown in FIG. 5, the escape path 38 is constituted by two channels 42, 44 formed in the base 16 and the cover 26, respectively, which are butt-joined to each other in only the this second angular position.

More particularly, the channel 42 is constituted by at least one first countersink 42, which is formed in the periphery of the end bearing area 36 of the sealing element 34, and which extends at least until the free end 46 of said bearing area 36 in order to connect with the outside of the cap 10.

The channel 44 is constituted by a second countersink 44, formed in a lower face 48 of the upper wall of the cover 16. This countersink 44 connects the periphery of the opening 30 with the passage chamber 32.

In the preferred embodiment of the invention, in order to promote the centering of the cover 26, the bearing area 36 of the sealing element 34 is tapered. The first countersink 42 is oriented along a generatrix of said tapered bearing area 36.

In a manner not limiting the invention, the second countersink 44 has, for its part, a radial orientation.

Of course, it will be understood that in case of the absence of an escape path 38, the cap 10 would still operate between its first and second positions. In the case of a squeeze bottle, it would remain compressed after its use in the second configuration.

To define the end positions of the cover 26 on the base 16, an inner tubular bearing area 50 of the cover 26 includes a least a first element and a second element projecting radially towards the inside of the cover 26. These elements are intended to simultaneously engage at least a first angular stop 52 and at least a first upper axial stop 54, secured to the base 16, respectively, to define the first configuration of the cap 10.

Moreover, the cover 26 includes at least a third element projecting radially towards the inside of the cover from its inner bearing area 50, and a fourth element inside the cover 26 which are intended to simultaneously engage at least a second angular stop 56 and the elastic return means 40, secured to the base 16, respectively, to define the second and third configurations of the cap 10.

The first to fourth elements could be completely independent. Nevertheless, for ease of manufacture and simplicity purposes, the inner tubular bearing area 50 of the cover 26 includes at least one pin 58, forming the first to fourth elements, which projects radially towards the inside of the cover 26, and which is intended to engage at least one oblong track 62 which extends in the periphery of a lower end 60 of the base 16 along an angular sector "$\alpha$" corresponding to the angle formed between the first and second angular positions.

The track 62 includes the first angular stop 52, first upper axial stop 54, second angular stop 56 and elastic return means 40, and it defines the first to third configurations of the cap 10 by providing a guidance of the pin 58 during the rotation of the cover 26.

To that purpose, the track 62 includes a first section 64, with a width corresponding to the height of the pin 58, which includes a first end 52 of the track forming the first angular stop of the pin 58, an upper edge 54 of which defines the first upper axial stop of the pin 58, to define the first configuration of the cap 10, as shown in FIG. 4.

The track 62 then includes a second section 66, with a width corresponding to the height of the pin 58, including a first boss 68, borne, in particular, by a lower edge 71 of the track 62, which is placed at a distance from the first end 52 of the track 62 substantially corresponding to the width of the pin 58, allowing the pin 58 to be locked in the first section 64, and which the pin 58 can cross over when the cover 26 is rotated.

Then the track 62 includes a third free section 70. Then the track 62 includes a fourth section 72, with a width corresponding to the height of the pin 58, including a second boss 74, borne, in particular, by a lower edge 71 of the track 62, which is placed at a distance from a second end 56 of the track 62 substantially corresponding to the width of the pin 58, allowing the pin 58 to be locked in a fifth section 76, and which the pin 58 can cross over when the cover 26 is rotated.

Then the track 62 includes the fifth section 76, which extends between the second boss 74 and the second end 56 of the track. This fifth section 76 includes a second end of the track forming the second angular stop 56 of the pin 58, and an elastically returned upper edge 40 which forms the elastic return means, in order to define the second and third configurations of the cap 10.

More particularly, the upper edge 40 of the fifth elastically returned section is borne by an elastic lug 78, a first end 80 of which consists of a single piece with a first cylindrical part 82 of a body 84 of the base 16, and which extends with a defined clearance "e" about a second cylindrical part 86 of the body 84 of the base.

A second end 88 of the lug 78 is flexible and free and it can thus bend so that its lower edge constitutes at least the upper edge 40 of the fifth section 76, forming an elastic return means.

It will be understood that the stiffness of the lug 78 will be adapted to the different viscosities of product to be dispensed in order to ensure the impermeability of the system in the third intermediate venting configuration.

It will also be understood in light of the present description that the inner tubular bearing area 50 of the cover 26 can include as many pins 58, angularly spread in a regular manner, as the base 16 can include similar tracks 62 and elastic lugs 40, the point being that the tracks 62 correspond to angular and axial movements of the pin 58 with the same amplitude. However, it is preferable to have at least two pins 58 for balancing purposes of the cover 26.

Consequently, it will be understood that, in order to ensure that the countersinks 42, 44 match with each other, whatever the track 62 receiving a defined pin 58, the base 16 includes as many countersinks 42 as tracks 62, the mounting of the cover 26 on the base 16 allowing in the third position at least one countersink 42 to match with the countersink 44, the other countersinks 42 being unused. It is thus unnecessary to interpose any indexing pin between the base 16 and the cover 26.

In FIG. 5 is shown a base 16 including two countersinks 42 since the base has two tracks 62. It will be understood that a base including for example three tracks 62 would include in a similar way three countersinks 42.

It will also be noted, among other advantages, that the base 16 includes at least two crescent-shaped holes 24 angularly spread in a regular manner about the sealing element 34, which each form an inlet opening 24.

Ultimately, advantageously, the cover 26 includes at least one external mean for fixing a covering element (not shown) matching with the product outlet opening 30.

Therefore, the invention proposes an anti-drip cap 10 that is particularly innovative, in that it allows the dispersion and drying of the product to be prevented, and advantageous, in that it is formed from a limited number of pieces, and can thus, in this respect, be mass-produced at a reduced cost.

The invention claimed is:

1. An anti-drip cap for a deformable bottle (12) containing a cosmetic, pharmaceutical, industrial or food product in liquid or cream form, including:

a substantially tubular base (16), which is intended to be fixed on a complementary tubular neck (14) of the bottle (12), and an inlet transverse wall (22) of which that seals the neck (14) of the bottle (12) which includes at least one inlet opening (24) connecting with the inside of the bottle (12), a substantially tubular cover (26), which covers the base (16), and an upper transverse wall (28) of which includes at least one product outlet opening (30), the cover (26) and the base (16) defining an impermeable passage chamber (32) for the passage of the product, interposed between the inlet opening (24) of the base (16) and the outlet opening (30) for the product, said cap being likely to occupy at least:

a sealing and locking, first configuration, associated with a first angular end position of the cover and with a first low axial position of said cover (26) with respect to the base (16), in which the cover (26) is immobilized on the base (16) and in which the product outlet opening (30) is lowered onto a sealing element (34) which projects coaxially with the base (16) from the inlet transverse wall (22), an end bearing area (36) of the sealing element (34) sealing the product outlet opening (30), a dispensing, second configuration, associated with a second angular end position of the cover (26) and with a second high axial position of said cover (26) with respect to the base (16) in which the outlet opening (30) is placed with a high clearance (J) above the sealing element (34) in order to allow the product to pass through the inlet and outlet openings (24) and (30) and the passage chamber (32), once product is ejected from the deformable bottle (12), passing through a venting, third intermediate configuration in which the relative positions of the cover (26) and of the base (16) an escape path (38) with small dimensions connecting the passage chamber (32) with the outside in order to ventilate the deformable bottle (12), in particular, allowing the deformable bottle (12) to regain shape after having been deformed, wherein the venting, third intermediate configuration, is associated with the second angular end position of the cover (26) and with the first low axial position of said cover (26) with respect to the base (16), and in that, in the second angular position of the cover, a defined-stiffness elastic return means (40) is interposed between the cover (26) and the base (16) in order to allow the cap (10) to pass from the third to the second configuration, the cover (26) raising towards the dispensing high position once an injection of product coming from the neck (14) of the bottle (12) exerts on the upper wall (28) of the passage chamber (32) a pressure that is sufficient for the resulting force to exceed the force of said elastic return means (40), and the automatic return of the cap from the third to the second configuration, the cover (26) being returned towards the low vertical position on the base (16) once the pressure of the product is released.

2. The cap (10) according to claim 1, wherein the escape path (38) is constituted by two channels (42, 44) formed in the base (16) and the cover (26), respectively, which are butt-joined to each other in only the second angular position.

3. The cap (10) according to claim 2, wherein the channels (42, 44) include:

at least one first countersink, which is formed in the periphery of the end bearing area (36) of the sealing element (34), and which extends at least until the free end (46) of said bearing area (36) in order to connect with the outside of the cap (10), and a second countersink, formed in a lower face (48) of the upper wall (28) of the cover (26), which connects the periphery of the opening (30) and the passage chamber (32).

4. The cap (10) according to claim 3, wherein the bearing area (36) of the sealing element (34) is tapered, and the first countersink (42) is oriented along a generatrix of said tapered bearing area (36).

5. The cap (10) according to claim 3, wherein the second countersink has a radial orientation.

6. The cap (10) according to claim 1, wherein an inner tubular bearing area (50) of the cover (26) includes at least a first element and a second element projecting radially towards the inside of the cover (26) which are intended to simultaneously engage at least a first angular stop (52) and at least a first upper axial stop (54), secured to the base (16), respectively, to define the first configuration of the cap (10).

7. The cap (10) according to claim 6, wherein the cover (26) includes at least a third element projecting radially towards the inside of the cover from the inner bearing area, and a fourth element inside the cover which are intended to simultaneously engage at least a second angular stop (56) and the elastic return means (40), secured to the base (16), respectively, to define the second and third configurations of the cap (10).

8. The cap (10) according to claim 7, wherein the inner tubular bearing area (50) of the cover (26) includes at least one pin (58), forming the first to fourth elements, which projects radially towards the inside of the cover (26), and which is intended to engage at least one oblong track (62) which extends in the periphery of a lower end (60) of the base (16) along an angular sector (a) corresponding to the angle formed between the first and second angular positions, said track (62) including the first angular stop (52), first upper axial stop (54), second angular stop (56) and elastic return means (40), and guiding the pin (58) to define the first to third configurations of the cap (10).

9. The cap (10) according to claim 8, wherein the track (62) includes:

a first section (64), with a width corresponding to the height of the pin (58), which includes a first end (52) of the track forming the first angular stop of the pin (58), an upper edge (54) of which defines the first upper axial stop of the pin (58), to define the first configuration of the cap (10), a second section (66), with a width corresponding to the height of the pin (58), including a first boss (68), borne in particular by a lower edge (71) of the track (62), which is placed at a distance from the first end (52) of the track (62) substantially corresponding to the width of the pin (58), allowing the pin (58) to be locked in the first section (64), and which the pin (58) can cross over when the cover (26) is rotated, a third section (70), a fourth section (72), with a width corresponding to the height of the pin (58), including a second boss (74), borne in particular by a lower edge (71) of the track 62, which is placed at a distance from a second track end (56) substantially corresponding to the width of the pin (58), allowing the pin (58) to be locked in a fifth section (76), and which the pin (58) can cross over when the cover (26) is rotated, and the fifth section (76), which extends between the second boss (74) and the second end (56) of the track, which includes a second end of the track forming the second angular stop (56) of the pin (58), and an elastically returned upper edge (40) of which forms the elastic return means, to define the second and third configurations of the cap (10).

10. The cap (10) according to claim 9, wherein the upper edge (40) of the fifth section (76) is borne by an elastic lug (78), a first end (80) of which consists of a single piece with a first cylindrical part (82) of a body (84) of the base, which extends with a defined clearance (e) about a second cylindrical part (86) of the body (84) of the base, and a second free flexible end (88) of which includes a lower edge constituting the upper edge (40) of the fifth section (76).

11. The cap (10) according to claim 10, wherein the inner tubular bearing area (50) of the cover (26) includes as many pins (58), angularly spread, as the base includes tracks (62), elastic lugs (78) and first countersinks (42), angularly spread.

* * * * *